US009915124B2

(12) United States Patent
Morrison

(10) Patent No.: US 9,915,124 B2
(45) Date of Patent: Mar. 13, 2018

(54) PISTON FLOAT EQUIPMENT

(71) Applicant: Weatherford Technology Holdings, LLC, Houston, TX (US)

(72) Inventor: Jeffery Morrison, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 551 days.

(21) Appl. No.: 14/509,938

(22) Filed: Oct. 8, 2014

(65) Prior Publication Data

US 2015/0101809 A1 Apr. 16, 2015

Related U.S. Application Data

(60) Provisional application No. 61/889,325, filed on Oct. 10, 2013.

(51) Int. Cl.

| | |
|---|---|
| ***E21B 33/14*** | (2006.01) |
| ***E21B 34/10*** | (2006.01) |
| ***E21B 34/14*** | (2006.01) |
| ***E21B 21/10*** | (2006.01) |

(52) U.S. Cl.

CPC ..... *E21B 33/14* (2013.01); *E21B 21/10* (2013.01); *E21B 34/10* (2013.01); *E21B 34/14* (2013.01)

(58) Field of Classification Search

CPC ..... E21B 21/10; E21B 33/14; E21B 34/10; E21B 34/14

See application file for complete search history.

(56) References Cited

U.S. PATENT DOCUMENTS

| | | | | |
|---|---|---|---|---|
| 2,846,015 A | | 8/1958 | Pittman | |
| 3,527,299 A | * | 9/1970 | Lewis | E21B 17/14 166/184 |
| 4,683,955 A | * | 8/1987 | Stepp | E21B 21/10 166/326 |
| 4,687,019 A | * | 8/1987 | Mayfield | E21B 21/10 137/375 |
| 5,450,903 A | * | 9/1995 | Budde | E21B 21/10 166/321 |
| 5,680,902 A | | 10/1997 | Giroux et al. | |
| 5,909,771 A | * | 6/1999 | Giroux | E21B 21/10 166/120 |
| 8,757,268 B2 | * | 6/2014 | Lejeune | E21B 21/10 137/515.5 |

(Continued)

FOREIGN PATENT DOCUMENTS

| | | |
|---|---|---|
| GB | 2314106 | 12/1997 |
| GB | 2147641 | 5/2015 |
| WO | 99/27226 | 6/1999 |

OTHER PUBLICATIONS

PCT Search Report and Written Opinion for International Application No. PCT/US2014/059932 dated Feb. 18, 2015.

*Primary Examiner* — Caroline N Butcher

(74) *Attorney, Agent, or Firm* — Patterson & Sheridan, L.L.P.

(57) ABSTRACT

A valve includes a housing having a bore. The valve further includes a piston member movable between a first position permitting fluid passage through the bore and a second position obstructing the bore through the housing. Additionally, the valve includes a biasing member configured to bias the piston member toward the second position. A method of using a valve in a cementing operation is provided.

24 Claims, 10 Drawing Sheets

(56) References Cited

U.S. PATENT DOCUMENTS

| | | | | |
|---|---|---|---|---|
| 2002/0020558 | A1* | 2/2002 | Gonzalez | E21B 21/001 175/5 |
| 2007/0246224 | A1 | 10/2007 | Krauss et al. | |
| 2009/0211814 | A1* | 8/2009 | de Boer | E21B 21/10 175/57 |

* cited by examiner

PISTON FLOAT EQUIPMENT

BACKGROUND OF THE INVENTION

Field of the Invention

Embodiments of the invention generally relate to a cementing operation. More particularly, embodiments of the invention relate to a valve assembly for use during a cementing operation.

Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the wellbore. A cementing operation is then conducted in order to fill the annular area with cement. The combination of cement and casing strengthens the wellbore, and facilitates the isolation of certain areas of the formation behind the casing for the production of hydrocarbons.

During a cementing operation, a float shoe is attached to the bottom of the casing string, which is run into the wellbore. The float shoe typically has a one-way valve located within the shoe. The casing is run into the wellbore to the desired depth and a cementing operation is performed. The cementing operation commences with a first plug being dropped into the casing. The first plug typically has a through bore with a rupture disk therein. Behind the plug, cement is pumped into the casing. Following the cement, a second typically solid plug is dropped into the casing. The first plug lands on the float shoe. As the pressure of the cement behind the first plug increases, the rupture disk fails. The cement flows through the bore of the first plug and past the one-way valve in the float shoe until the second plug reaches the first plug. The one-way valve allows the cement to flow out of the float shoe and into the annulus between the casing and a wellbore therearound, while preventing the cement from re-entering the casing string. Typically, the one-way valve in the float shoe includes a flapper valve or a poppet valve. However, these valves are not designed to hold wellbore pressure. Therefore, there is a need for a valve that can hold wellbore pressure.

SUMMARY OF THE INVENTION

Embodiments of the invention generally relate to a valve assembly for use during a cementing operation. In one embodiment, the valve assembly includes a housing having a bore, a piston member movable between a first position permitting fluid passage through the bore and a second position obstructing fluid passage through the bore. Additionally, the valve assembly includes a biasing member configured to bias the piston member toward the second position. In one embodiment, the piston member is configured to move to the first position in response to fluid flowing at a predetermined flow rate through the bore.

In another embodiment, a method of performing a cementing operation in a wellbore includes positioning a casing and a valve in the wellbore, the valve having a piston member that is movable in a housing between a first position and a second position; moving the piston member to the first position to permit fluid passage through a bore of the housing; pumping cement through the casing and the valve and out into an annulus formed between the casing and the wellbore; and moving the piston member from the first position to the second position, whereby the piston member obstructs the bore of the housing.

In a further embodiment, a valve for use in a wellbore includes a housing having a fluid bore and a piston bore; and a piston member disposed in the piston bore and movable between a first position and a second position, the piston member configured to intersect the fluid bore when the piston member is in the second position, whereby fluid communication through the piston bore is blocked.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a valve assembly for use during a cementing operation. The valve assembly will be described in relation to a float shoe and a shoe track. It is to be understood, however, that the valve assembly may also be used as a cement shoe without departing from principles of the invention. To better understand the novelty of the valve assembly and the methods of use thereof, reference is hereafter made to the accompanying drawings.

Figure 1:
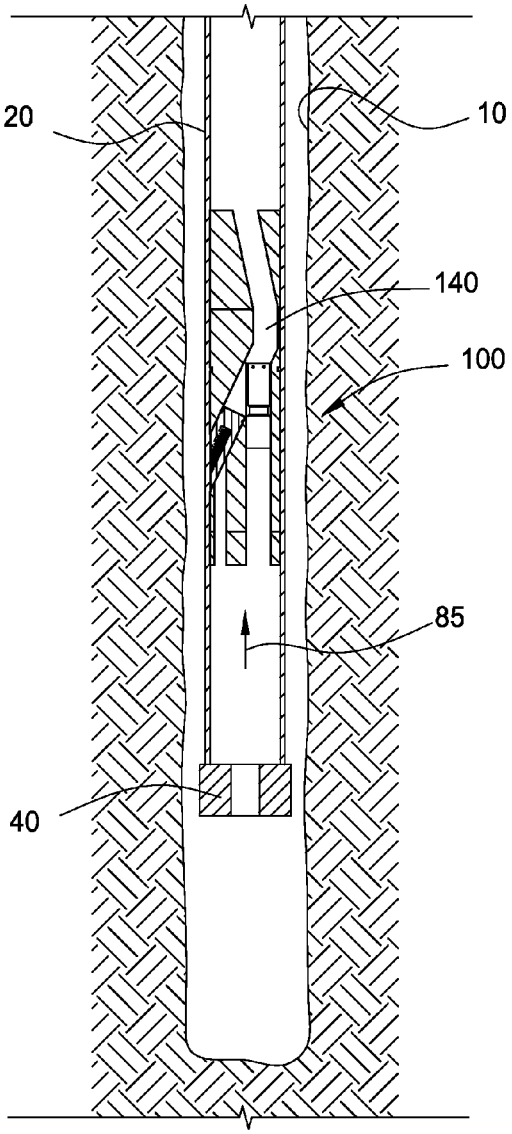
FIG. 1 illustrates a view of a valve assembly.

FIG. 1 illustrates an exemplary valve assembly 100. As shown, the valve assembly 100 is attached to a casing 20. At the lower end of the casing 20 is a shoe 40. As the casing 20 is being lowered into a wellbore 10, wellbore fluid enters the casing 20 by flowing through the shoe 40 and the valve assembly 100 in the direction indicated by arrow 85. The valve assembly 100 is movable between an open position (FIG. 3A) and a closed position (FIG. 4A).

Figure 1A:
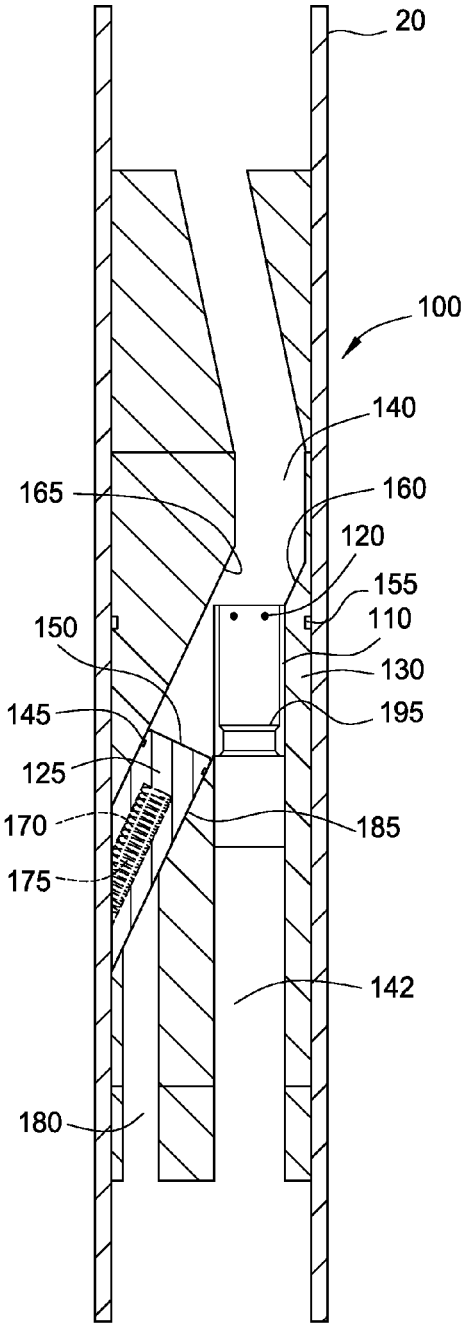
FIG. 1A illustrates an enlarged view of the valve assembly shown in FIG. 1.

FIG. 1A is an enlarged view of the valve assembly 100 shown in FIG. 1. The valve assembly 100 is in an open position, which allows fluid flow through the valve assembly 100. The valve assembly 100 may be temporarily held in the open position by a sleeve member 110. The sleeve member 110 is attached to a housing 130 of the valve assembly 100 via a releasable connection 120, such as a shear screw. As described herein, the sleeve member 110 is configured to be removed from the valve assembly 100 at a predetermined time. After the sleeve member 110 is removed from the valve assembly 100, the valve assembly 100 may be moved between the open position (FIG. 3A) and the closed position (FIG. 4A) any number of times. The sleeve member 110 includes a seat 195 configured to receive a fluid-blocking member. As shown in FIG. 1A, a seal member 155 is placed between the valve assembly 100 and the casing 20.

The valve assembly 100 includes a piston member 125 that is movable axially within a piston bore 185 of the housing 130. As shown, the piston bore 185 can fluidly communicate with an upper bore 140 and a lower bore 142 of the housing 130. The valve assembly 100 is open when the piston member 125 is in the retracted position, and the valve assembly 100 is closed when the piston member 125 is in the extended position. In the retracted position as shown in FIG. 1A, the piston member 125 is substantially disposed in the piston bore 185, and fluid in the upper bore 140 is allowed to flow into the lower bore 142, bypassing the piston bore 185. As shown, the piston member 125 is held in the retracted position by the sleeve member 110. In one embodiment, when the piston member 125 is in the retracted position, at least 70%, at least 85%, or at least 95% of the bore 140 of the valve assembly 100 is unobstructed by the piston member 125. In another embodiment, the full bore 140 of the valve assembly 100 is open. In the extended position as shown in FIG. 4A, the piston member 125 extends from the piston bore 185 to obstruct fluid communication to the lower bore 142 of the valve assembly 100.

The piston member 125 may be connected to a biasing member 175. The biasing member 175 is configured to bias the piston member toward the extended position. The biasing member 175 may be a spring, a washer, an elastomer or any other suitable type of biasing member known in the art. The biasing member 175 is configured to push (or bias) the piston member 125 out of the piston bore 185 of the valve assembly 100. A single biasing member is shown in FIG. 1A, however, there may be any number of biasing members, such as two, three, four, or more, without departing from principles of the invention. As shown in FIGS. 3A and 4A, the biasing member 175 is movable between a first axial position (i.e., compressed state), and a second axial position (i.e., uncompressed state) as the piston member 125 moves within the piston bore 185 of the housing 130. In one embodiment, the biasing member 175 is at least partly disposed in a bore 170 of the piston member 125. Optionally, the piston member 125 may be coupled to the piston bore 185 using a key and groove connection to prevent rotation of the piston member 125 while moving relative to the piston bore 185.

Figure 2:
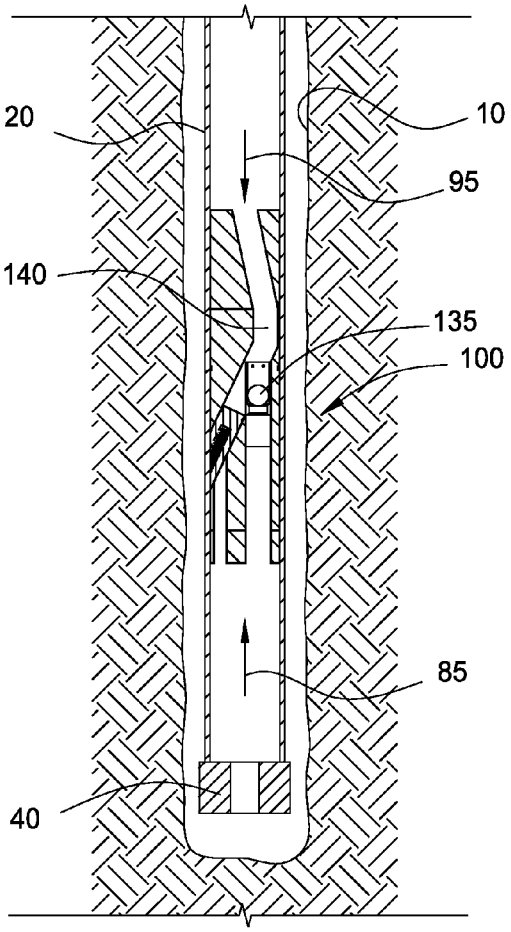
FIG. 2 illustrates a view of a fluid-blocking member in the valve assembly shown in FIG. 1.
Figure 2A:
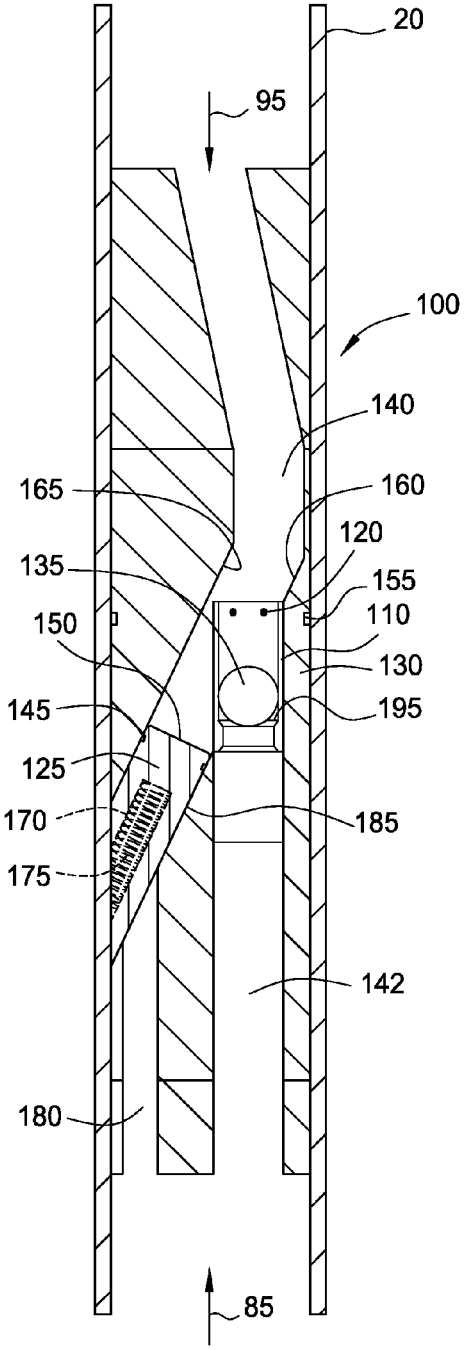
FIG. 2A illustrates an enlarged view of the valve assembly shown in FIG. 2.

FIG. 2 illustrates a view of a fluid-blocking member 135 in the valve assembly 100. After the casing 20 has been positioned within the wellbore 10, the fluid-blocking member 135 is dropped or pumped through the casing 20 from the surface of the well. The fluid-blocking member 135 may be a ball, a dart or any other fluid-blocking member. The fluid-blocking member 135 moves through the casing 20 in the direction indicated by arrow 95 until it lands in the seat 195 in the sleeve member 110 (FIG. 2A). After the fluid-blocking member 135 is positioned in the seat 195, fluid flow through the casing 20 is blocked in a first direction, which is indicated by arrow 95. Thereafter, fluid is pumped into the casing 20 from the surface to create a fluid pressure in the valve assembly 100. At a predetermined fluid pressure, the releasable connection 120 between the sleeve member 110 and the housing 130 is released, thereby allowing the sleeve member 110 to move relative to the housing 130. Next, the sleeve member 110 will drop out of the valve assembly 100, and land in the wellbore or in a portion of casing 20 (not shown). At this point, the piston member 125 is movable in the piston bore 185 between the retracted position and the extended position. In another embodiment, the fluid-blocking member 135 may be part of the valve assembly 100 rather than being dropped from the surface of the well. In this embodiment, the fluid-blocking member is movable within the valve assembly 100 in a manner that allows fluid flow through the valve assembly 100 in the direction indicated by arrow 85, while it blocks fluid flow through the valve assembly 100 in the direction indicated by arrow 95.

Figure 3:
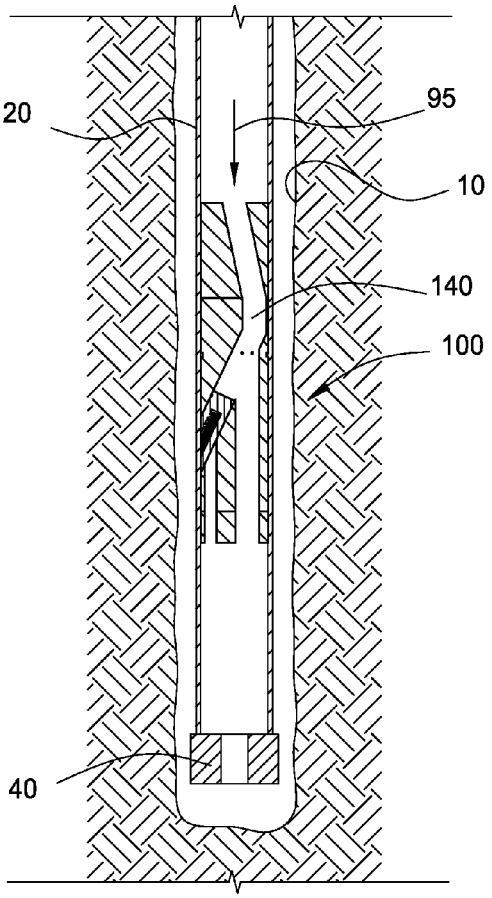
FIG. 3 illustrates a view of the valve assembly in an open position.
Figure 3A:
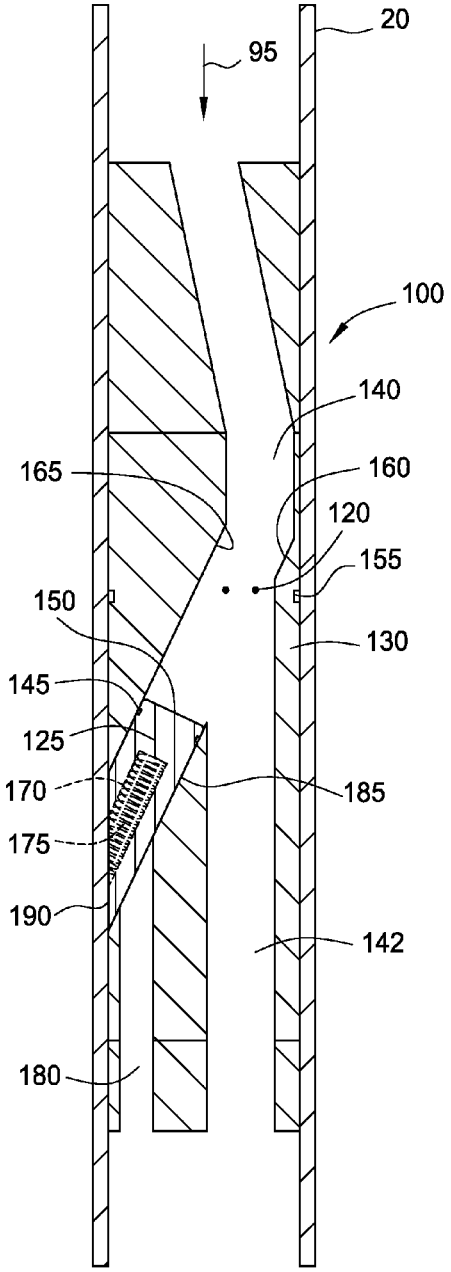
FIG. 3A illustrates an enlarged view of the valve assembly shown in FIG. 3.

FIGS. 3 and 3A illustrate views of the valve assembly 100 in the open position. In the open position, the piston member 125 does not obstruct the lower bore 142 of the valve assembly 100. As a result, fluid may flow through the valve assembly 100 in the direction indicated by arrow 95.

As shown in FIG. 3A, the piston member 125 includes a first surface 150 and a second surface 190. As fluid flows through the bore 140 of the valve assembly 100 in the direction indicated by arrow 95, the fluid acts on the first surface 150, which generates a force. At a predetermined flow rate, sufficient force is applied to the piston member 125 to move the piston member 125 toward the retracted position within the piston bore 185. At the same time, the biasing member 175 is compressed between the piston member 125 and the housing.130. As fluid flow in the direction indicated by arrow 95 is reduced, the force on the piston member 125 is reduced. When the force acting on the first surface 150 of the piston member 125 becomes less than the force generated by the biasing member 175, the piston member 125 moves within the piston bore 185 toward the extended position. In the extended position, the piston member 125 blocks fluid communication to the lower bore 142, thereby closing the valve assembly 100.

Figure 4:
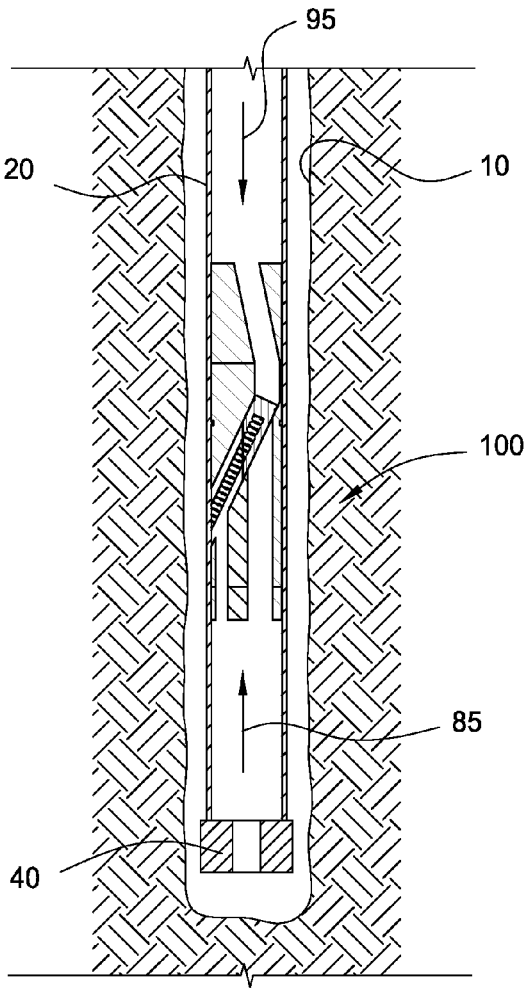
FIG. 4 illustrates a view of the valve assembly in a closed position.
Figure 4A:
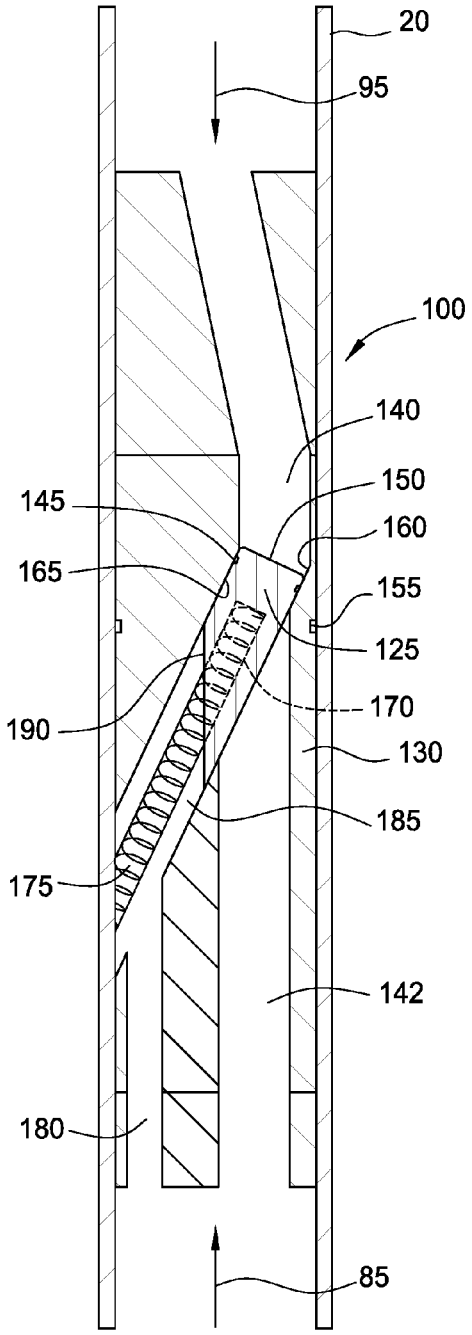
FIG. 4A illustrates an enlarged view of the valve assembly shown in FIG. 4.

FIGS. 4 and 4A illustrate views of the valve assembly 100 in the closed position. The lower bore 142 of valve assembly 100 is obstructed by the piston member 125 in the closed position. The piston member 125 includes a seal member 145, such as an o-ring. As shown, the seal member 145 is attached to the piston member 125 and thus, travels with the piston member 125. In one embodiment, the seal member 145 is disposed in a groove formed in the piston member 125. The seal member 145 is configured to engage and create a seal with the surfaces 160, 165 of the housing 130 when the piston member 125 is in the extended position. As a result, fluid flow through the lower bore 142 is blocked.

The biasing member 175 is configured to push (or bias) the piston member 125 toward the extended position, as set forth herein. In addition to the biasing member 175, wellbore fluid from the wellbore 10 may optionally be used to push the piston member 125 toward the extended position. For instance, wellbore fluid may act on the second surface 190 of the piston member 125, which in turn causes the piston member 125 to move within the piston bore 185 to the extended position. Specifically, wellbore fluid may flow through a side bore 180 of the housing 130 in the direction of arrow 85. The fluid in the side bore 180 acts on the second surface 190, which generates a push force on the piston member 125. The push force may be used to move the piston member 125 toward the extended position. As a result of the arrangements of the side bore 180 and the biasing member 175, the valve assembly 100 is biased in the closed position. As also shown, the biasing member 175 has moved from the compressed state (FIG. 3A) to the uncompressed state (FIG. 4A). The valve assembly 100 may be moved from the closed position to the open position by pumping fluid down the casing 20 in the direction of arrow 95. In one embodiment, a dart may be sent through the upper bore 140 to the lower bore 142 to activate a tool below the valve assembly 100.

Figure 5:
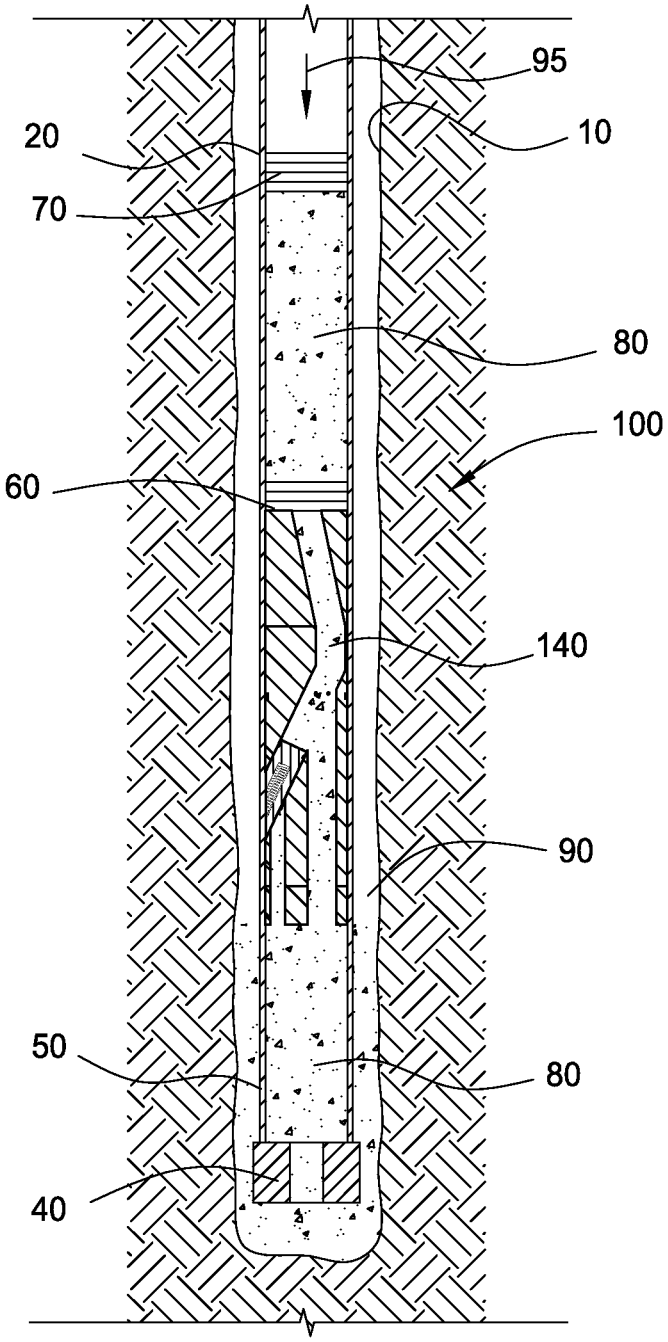
FIG. 5 illustrates a view of the valve assembly during a cementing operation.

FIG. 5 illustrates a view of the valve assembly 100 during a cementing operation. During the cementing operation, a first plug 60 is dropped (pumped) through the casing 20. The first plug 60 is followed by cement 80, which will be used for cementing an annulus 90 formed between the casing 20 and the wellbore 10. After the cement 80 is placed in the casing 20, a second plug 70 is dropped into the casing 20. The second plug 70 is pushed downhole by a pumping fluid (not shown). The pumping fluid may be any fluid capable of pushing the second plug 70 through the casing 20, such as drilling mud, water, etc. The first plug 60 travels down the casing 20 until it lands on the valve assembly 100 as shown in FIG. 5. Thereafter, a bump pressure is created between the first plug 60 and the valve assembly 100. As the pumping fluid pressure increases behind the second plug 70, bump pressure on the valve assembly 100 also increases. The bump pressure increases until a rupture disk (not shown) in the first plug 60 bursts. With the rupture disk bursts, the cement 80 flows through the first plug 60 and into the valve assembly 100. Initially, when the rupture disk bursts, a portion of the bump pressure is relieved from the top of the valve assembly 100. The fluid pressure from the cement 80 may then open the valve assembly 100 in a similar manner as set forth herein. The cement 80 then flows through the bore 140 of the valve assembly 100, and into a shoe track 50 between the valve assembly 100 and the shoe 40. Thereafter, the cement 80 flows out through the shoe 40 and into the annulus 90. The cement 80 continues to flow out into the annulus 90 until the second plug 70 lands on the first plug 60. Thereafter, the piston member 125 extends to block fluid communication through the lower bore 142, thereby closing the valve assembly 100. In the closed position, the cement 90 is prevented from flowing back into the casing 20 or U-tubing.

The casing 20 may include one or more wickers disposed above and below the valve assembly 100. The wickers may be one or more recess disposed on the inner surface of the casing 20. The wickers may be filled with a retaining material, such as cement, to form retaining members (not shown) above and below the valve assembly 100. The retaining members may engage the inner surface of the casing 20, including the wickers, as well as the housing 130 to thereby provide axial restraint of the valve assembly 100 within the casing 20. When desired, the retaining members may be drilled out to remove the valve assembly 100 from the casing 20. In one embodiment, the retaining members may include one or more flow paths for fluid communication with the piston member 125.

In operation, pressurized fluid may be supplied from the surface through the casing 20 (illustrated in FIG. 3) in the direction of the arrow 95. The pressurized fluid acts on the first surface 150 of the piston member 125, which generates a force that causes the piston member 125 to move to the retracted position. As a result, the valve assembly 100 is in the open position. To move the valve assembly 100 to the closed position, the pressurized fluid in the direction of the arrow 95 may be reduced. When the force generated by fluid flow acting on the first surface 150 of the piston member 125 becomes less than the force generated by the biasing member 175, the piston member 125 moves within the piston bore 185 toward the extended position. As a result, the valve assembly 100 is in the closed position.

Figure 2B:
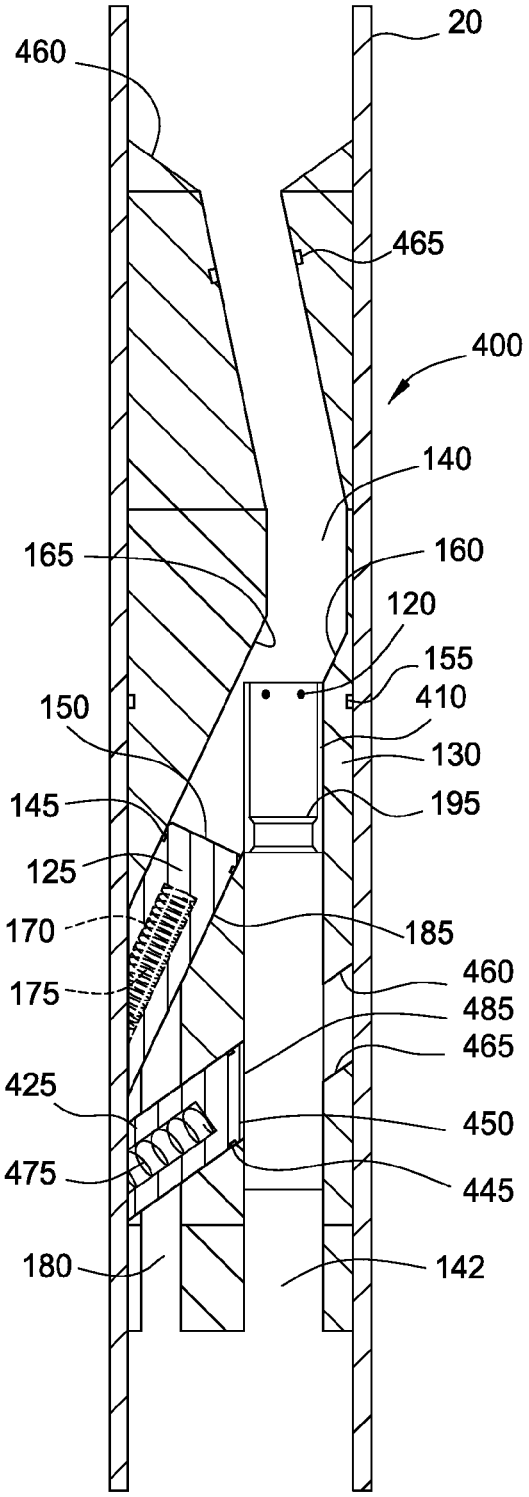
FIG. 2B illustrates another embodiment of a valve assembly.

FIG. 2B illustrates another embodiment of the valve assembly 400. As shown, the valve assembly 400 includes two piston members 125, 425. The piston members 125, 425, may be retained in the open position using a single sleeve member 410. In another embodiment, each piston member 125, 425 may be retained using different sleeve members. In one example, the sleeve member for the lower piston member 425 may be adapted to receive a smaller occlusion member that will travel through the sleeve member 110 of the upper piston member 125. The valve assembly 400 may optionally include a bevel 460 disposed at an upper end to facilitate travel through the bore 140. The valve assembly 400 may optionally include a latch profile 465 to facilitate attachment of one or more tools to the valve assembly 400.

Figure 4B:
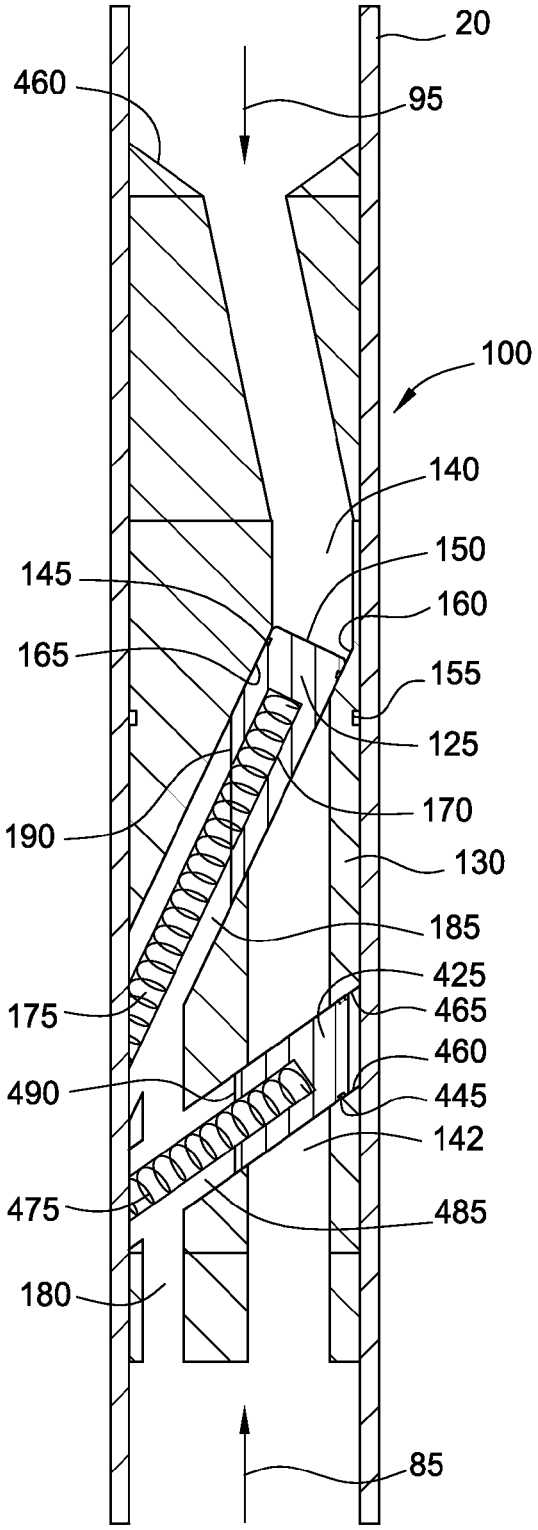
FIG. 4B illustrates the valve assembly shown in FIG. 2B in the open position.

FIG. 4B illustrates the valve assembly 400 in the closed position. The sleeve member 410 has been released from the housing 130 by a fluid blocking member and increasing pressure above the sleeve member 410. The lower bore 142 of valve assembly 400 is obstructed by the piston members 125, 425 in the closed position. The upper piston member 125 includes a seal member 145, such as an o-ring. As shown, the seal member 145 is attached to the piston member 125 and thus, travels with the piston member 125. The lower piston member 425 may also include a seal member 445. In one embodiment, the seal members 145, 445 of the piston members 125, 425 are disposed in a groove formed in the piston members 125, 425. The seal member 145 is configured to sealingly engage with the surfaces 160, 165 of the housing 130 and the seal member 445 is configured to sealingly engage with the surfaces 460, 465 of the housing 130, when the piston members 125, 425 are in the extended position. As a result, fluid flow through the lower bore 142 is blocked.

The biasing members 175, 475 are configured to push (or bias) the piston members 125, 425 toward the extended position, as set forth herein. In addition to the biasing members 175, 475, wellbore fluid from the wellbore 10 may optionally be used to push the piston members 125, 425 toward the extended position. For instance, wellbore fluid may act on the second surfaces 190, 490 of the piston members 125, 425 which in turn cause the piston members 125, 425 to move within their respective piston bores 185, 485 to the extended position. Specifically, wellbore fluid may flow through a side bore 180 of the housing 130 in the direction of arrow 85. The fluid in the side bore 180 acts on the second surfaces 190, 490, which generates a push force on the piston members 125, 425. The push force may be used to move the piston members 125, 425 toward the extended position. The valve assembly 400 may be moved from the closed position to the open position by pumping fluid down the casing 20 in the direction of arrow 95. In one embodiment, when the valve assembly 400 is open, a dart may be sent through the upper bore 140 to the lower bore 142 to activate a tool below the valve assembly 400.

Figure 6:
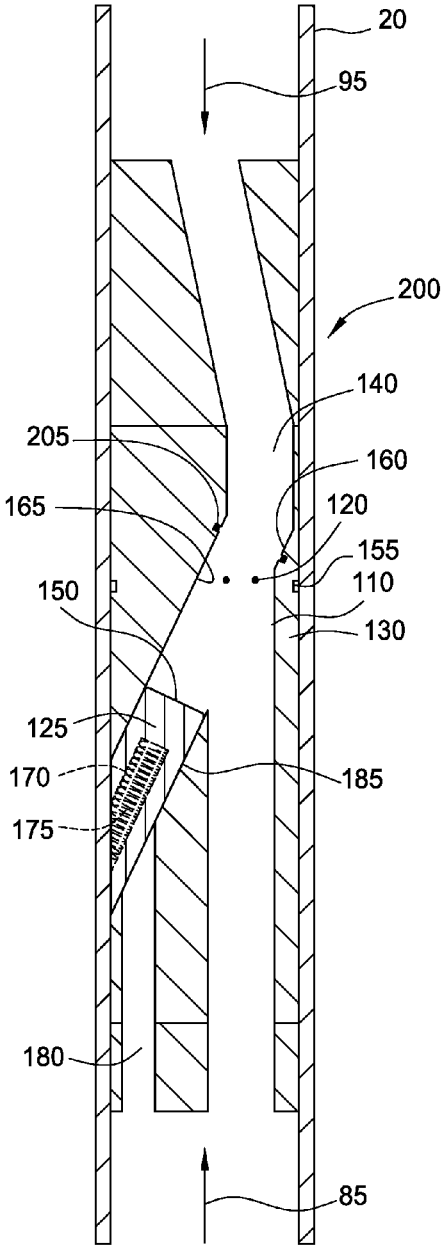
FIG. 6 illustrates an embodiment of a valve assembly in an open position.

FIG. 6 illustrates an embodiment of a valve assembly 200. For convenience, the components in the valve assembly 200 that are similar to the components in the valve assembly 100 will be labeled with the same reference number indicator. The valve assembly 200 is movable between an open position and a closed position in a similar manner as described herein.

As shown in FIG. 6, a seal member 205 is disposed in the bore 140. The seal member 205 is attached to the housing 130, and thus remains stationary as the piston member 125 moves between the retracted position and the extended position. In one embodiment, the seal member 205 is disposed in a groove formed in the housing 130.

Figure 7:
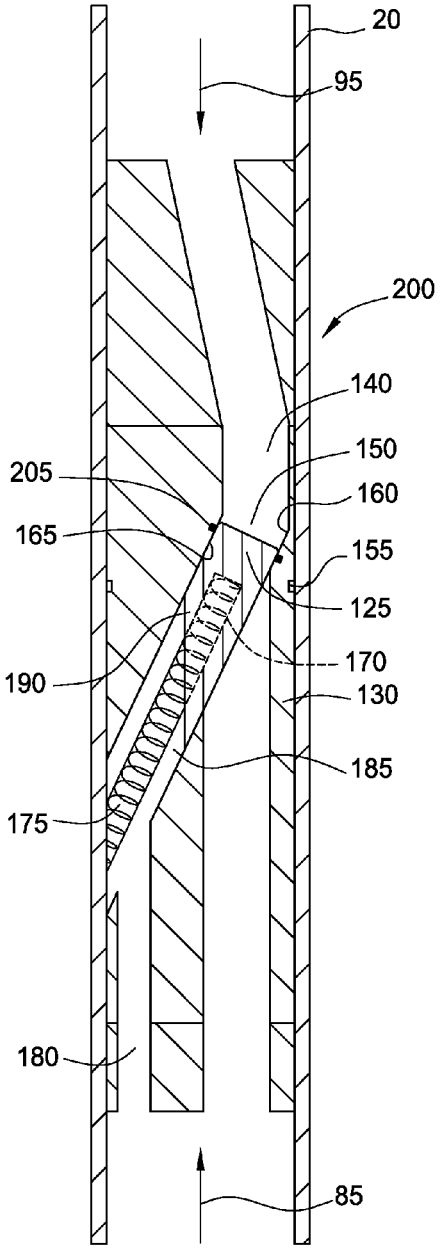
FIG. 7 illustrates a view of the valve assembly of FIG. 6 in a closed position.

FIG. 7 illustrates the valve assembly 200 in a closed position. To close the valve assembly 200, the piston member 125 is moved from the retracted position to the extended position in a similar manner as set forth herein. The seal member 205 is configured to engage and create a seal with the piston member 125 when the piston member 125 is in the extended position. As a result, fluid flow through the lower bore 142 of the valve assembly 200 is blocked.

Figure 8:
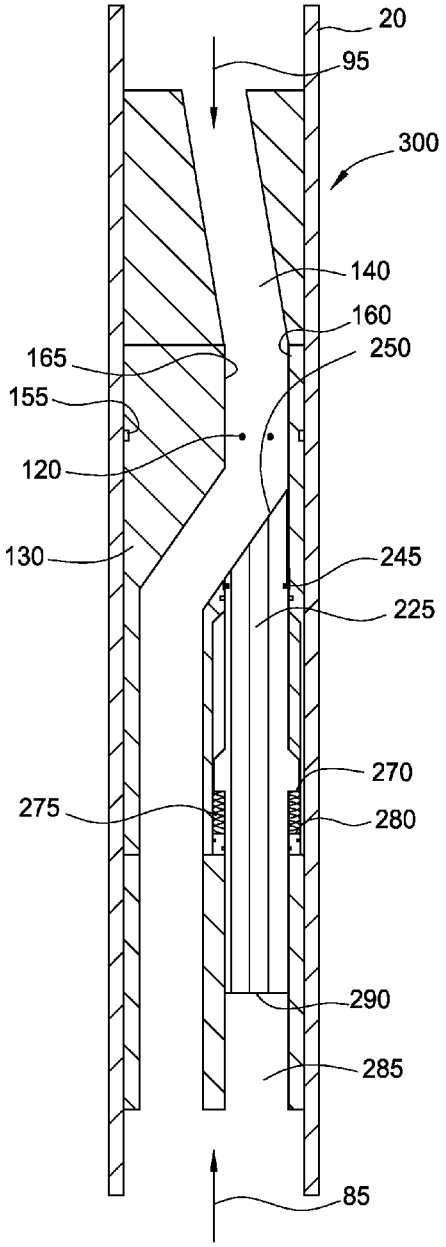
FIG. 8 illustrates an embodiment of a valve assembly in an open position.

FIG. 8 illustrates an embodiment of a valve assembly 300 in an open position. For convenience, the components in the valve assembly 300 that are similar to the components in the valve assembly 100 will be labeled with the same number indicator. The valve assembly 300 is movable between an open position and a closed position.

The valve assembly 300 includes a piston member 225 that is movable axially within a piston bore 285 of the housing 130. The piston member 225 is movable between a retracted position (i.e., open position of the valve assembly 300), in which the piston member 225 is substantially disposed in the piston bore 285 and an extended position (i.e., closed position of the valve assembly 300), in which the piston member 225 extends from the piston bore 285 to obstruct the bore 140 of the valve assembly 300. The piston member 225 may be initially held in the retracted position by the sleeve member (not shown) as described herein.

The piston member 225 may be connected to a biasing member 275. The biasing member 275 is configured to bias the piston member 225 toward the extended position. The biasing member 275 may be a spring, a washer, an elastomer, or any other suitable type of biasing member known in the art. The biasing member 275 is configured to push (or bias) the piston member 225 toward the bore 140 of the valve assembly 300. The biasing member 275 is disposed between a shoulder 270 on the piston member 225 and a shoulder 280 in the housing 130. The biasing member 275 is movable between a first axial position (i.e., compressed state), and a second axial position (i.e., uncompressed state) as the piston member 225 moves within the piston bore 285 of the housing 130. FIG. 8 illustrates one biasing member; however, there may be any number of biasing members, without departing from principles of the invention.

Figure 10:
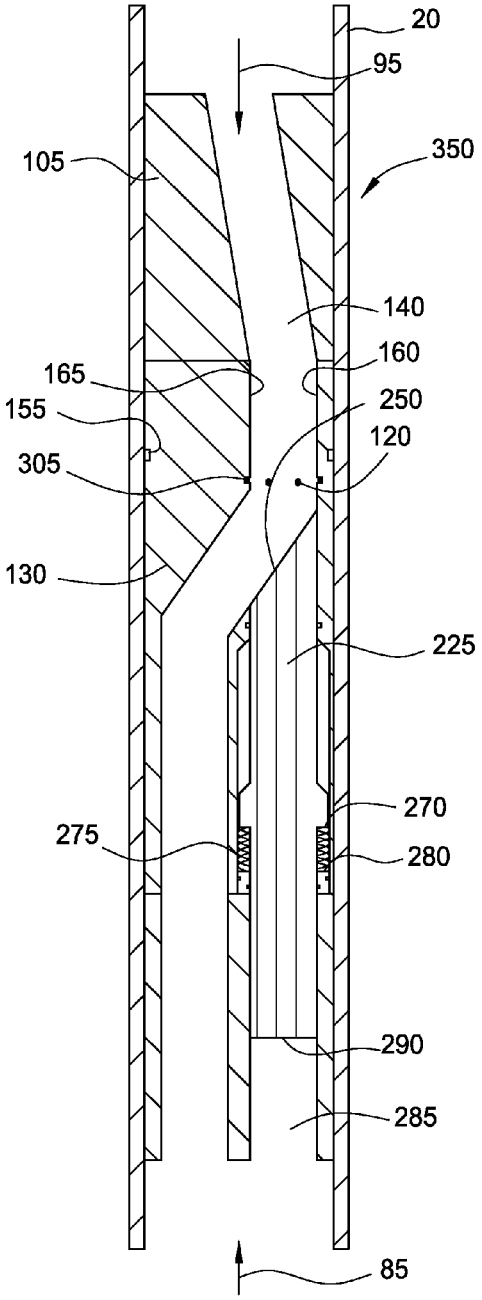
FIG. 10 illustrates an embodiment of a valve assembly in an open position.

In the open position, fluid may flow through the valve assembly 100 in the direction indicated by arrow 95. The piston member 225 includes a first surface 250 and a second surface 290. In the embodiment shown, the first surface 250 is positioned at an angle relative to a longitudinal axis of the piston member 225. As shown in FIG. 10, the first surface 250 forms (or defines) a portion of the wall of the bore 140 when the piston member 225 is in the retracted position. In another embodiment, the first surface 250 is perpendicular to the longitudinal axis of the piston member 225.

As fluid flows through the bore 140 of the valve assembly 300 in the direction indicated by arrow 95, the fluid acts on the first surface 250, which generates a force. The force is applied to the piston member 225, which is used to move the piston member 225 toward the retracted position within the piston bore 285. At the same time, the biasing member 275 is compressed between the shoulder 270 on the piston member 225 and the shoulder 280 in the housing 130. As fluid flow in the direction indicated by arrow 95 is reduced, the force on the piston member 225 is reduced. When the force generated by fluid flow acting on the first surface 250 of the piston member 225 becomes less than the force generated by the biasing member 275, the piston member 225 moves within the piston bore 285 toward the extended position. The piston member 225 intersects the bore 140 in the extended position.

Figure 9:
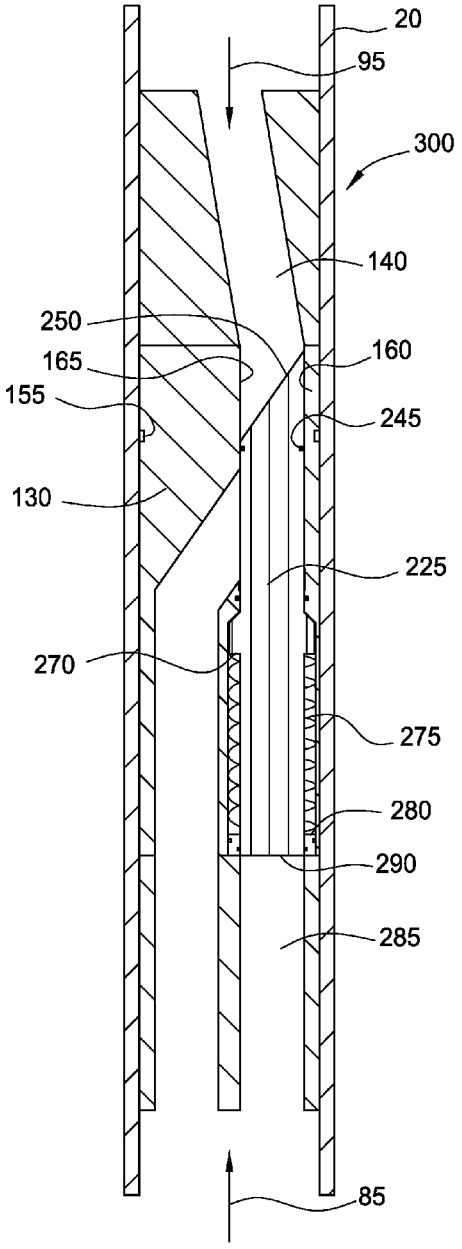
FIG. 9 illustrates a view of the valve assembly of FIG. 8 in a closed position.

FIG. 9 illustrates a view of the valve assembly 300 in the closed position. In the closed position, the upper bore 140 of valve assembly 300 is obstructed by the piston member 225 and fluid flow to the lower bore 142 is prevented. The piston member 225 includes a seal member 245, such as an o-ring. As shown, the seal member 245 is attached to the piston member 225. Thus, the seal member 245 moves with the piston member 225 as the piston member 225 moves between the retracted position and the extended position. In one embodiment, the seal member 245 is disposed in a groove formed in the piston member 225. The seal member 245 is configured to engage and create a seal with the surfaces 160, 165 of the bore 140 when the piston member 225 is in the extended position. As a result, fluid flow through the bore 140 of the valve assembly 300 is blocked.

The biasing member 275 is configured to push (or bias) the piston member 225 toward the extended position, as set forth herein. In addition to the biasing member 275, wellbore fluid from the wellbore may optionally be used to push the piston member 225 toward the extended position. For instance, wellbore fluid may act on the second surface 290 of the piston member 225, which in turn causes the piston member 225 to move within the piston bore 285 to the extended position. Specifically, wellbore fluid may flow through a piston bore 285 of the housing 130 in the direction of arrow 85. The fluid acts on the second surface 290, which generates a push force on the piston member 225. The push force may be used to move the piston member 225 toward the extended position. As such, the valve assembly 300 is biased in the closed position. As also shown, the biasing member 275 has moved from the compressed state to the uncompressed state. The valve assembly 100 may be moved from the closed position to the open position by pumping fluid down the casing 20 in the direction of arrow 95.

In operation, pressurized fluid may be supplied from the surface through the casing 20 in the direction of the arrow 95. The pressurized fluid acts on the first surface 250 of the piston member 225, which generates a force that causes the piston member 225 to move to the retracted position. As a result, the valve assembly 300 is in the open position. To move the valve assembly 300 to the closed position, the pressurized fluid in the direction of the arrow 95 may be reduced. When the force generated by fluid flow acting on the first surface 250 of the piston member 225 becomes less than the force generated by the biasing member 275, the piston member 225 is moved within the piston bore 285 toward the extended position. As a result, the valve assembly 300 is in the closed position.

FIG. 10 illustrates an embodiment of a valve assembly 350. For convenience, the components in the valve assembly 350 that are similar to the components in the valve assembly 100 will be labeled with the same number indicator. The valve assembly 350 is movable between an open position and a closed position in a similar manner as described herein.

As shown in FIG. 10, a seal member 305 is attached to the housing 130 and thus remains stationary as the piston member 225 moves between the retracted position and the extended position. In one embodiment, the seal member 305 is disposed in a groove formed in the housing 130.

Figure 11:
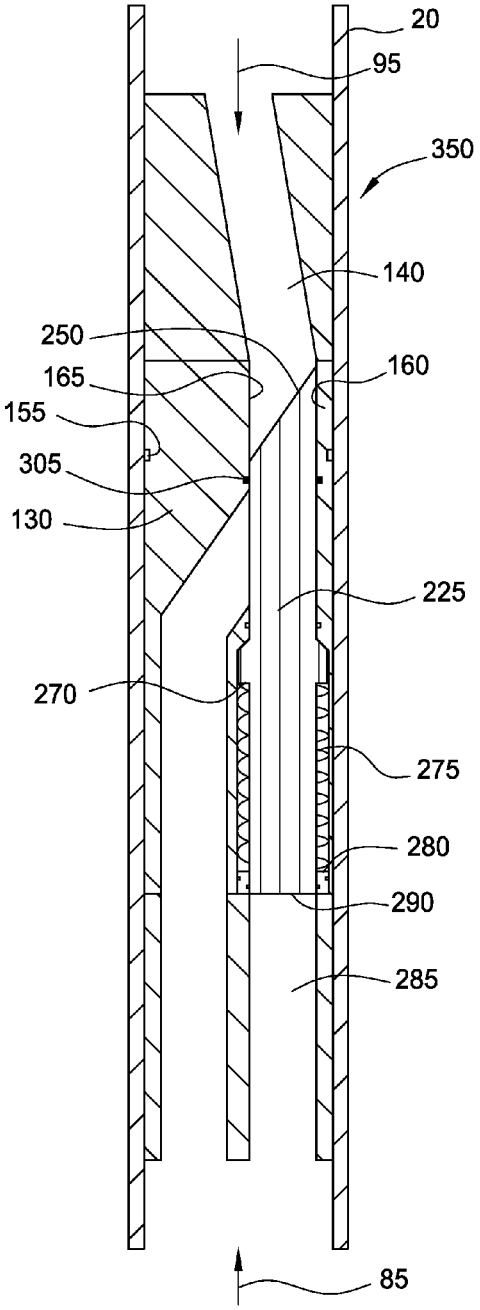
FIG. 11 illustrates a view of the valve assembly of FIG. 10 in a closed position.

FIG. 11 illustrates a view of the valve assembly 350 in a closed position. To close the valve assembly 350, the piston member 125 is moved from the retracted position to the extended position in a similar manner as set forth herein. The seal member 305 is configured to engage and create a seal with the piston member 125 when the piston member 125 is in the extended position. As a result, fluid flow through the bore 140 of the valve assembly 200 is blocked.

In one embodiment, a valve for use in a cementing operation is provided. The valve includes a housing having a bore. The valve further includes a piston member movable between a first position permitting fluid passage through the bore and a second position obstructing the bore through the housing. Additionally, the valve includes a biasing member configured to bias the piston member toward the second position.

In one or more embodiments, the piston member is configured to move to the first position in response to fluid flowing through the bore.

In one or more embodiments, a seal member is attached to the piston member. The seal member is configured to engage a surface of the bore when the piston member is in the second position.

In one or more embodiments, the seal member is disposed in a groove formed in the piston member.

In one or more embodiments, a seal member is disposed in the bore of the housing. The seal member is configured to engage a surface of the piston member when the piston member is in the second position.

In one or more embodiments, the seal member is disposed in a groove formed in the bore.

In one or more embodiments, the piston member moves to the first position when fluid flows through the bore of the housing in a first direction and the fluid acts on a first surface of the piston member.

In one or more embodiments, the piston member is at least partially biased in the second position by fluid that flows in a second direction, and the fluid acts on a second surface of the piston member, and wherein the second direction is opposite the first direction.

In one or more embodiments, the biasing member is a spring that is positioned between a portion of the housing and the piston member.

In one or more embodiments, the piston member includes a first end and a second end, the first end defines a portion of the bore when the piston member is in the first position.

In another embodiment, a method of performing a cementing operation in a wellbore includes positioning a casing and a valve in the wellbore, the valve having a piston member that is movable in a housing between a first position and a second position; moving the piston member to the first position to permit fluid passage through a bore of the housing; pumping cement through the casing and the valve and out into an annulus formed between the casing and the wellbore; and moving the piston member from the first position to the second position, whereby the piston member obstructs the bore of the housing.

In one or more embodiments, the method includes the step of creating a seal between the piston member and the bore of the housing when the piston member is in the second position.

In one or more embodiments, the piston member is at least partially biased in the second position by wellbore fluid.

In one or more embodiments, the method includes releasing a sleeve member from the housing.

In one or more embodiments, releasing the sleeve member comprises landing the fluid blocking member in the sleeve member.

In one or more embodiments, the method includes increasing pressure to release the sleeve member.

In a further embodiment, a valve for use in a wellbore includes a housing having a fluid bore and a piston bore; and a piston member disposed in the piston bore and movable between a first position and a second position, the piston member configured to intersect the fluid bore when the piston member is in the second position, whereby fluid communication through the piston bore is blocked.

In one or more embodiments, the piston member is disposed within the piston bore when the piston member is in the first position, and the piston member extends from the piston bore when the piston member is in the second position.

In one or more embodiments, a second piston member configured to obstruct the bore is provided in the casing.

In one or more embodiments, a sleeve member is releasably attached to the housing, wherein the sleeve member is configured to retain the piston member in the first position.

While the foregoing is directed to embodiments of the present invention, other and further embodiments of the invention may be devised without departing from the basic scope thereof, and the scope thereof is determined by the claims that follow.

The invention claimed is:

1. A valve for use in a cementing operation, the valve comprising:

a housing having a housing bore extending through the housing, wherein the housing bore is an eccentric bore;

a piston bore intersecting the housing bore;

a piston member disposed in the piston bore movable between a retracted position permitting fluid passage through the housing bore and an extended position obstructing the housing bore through the housing; and a biasing member configured to bias the piston member toward the extended position, wherein the piston member is configured to move to the retracted position in response to fluid flowing through the housing bore.

2. The valve of claim 1, further comprising a seal member attached to the piston member, the seal member being configured to engage a surface of the housing when the piston member is in the extended position.

3. The valve of claim 2, wherein the seal member is disposed in a groove formed in the piston member.

4. The valve of claim 1, further comprising a seal member disposed in the housing bore of the housing, the seal member being configured to engage a surface of the piston member when the piston member is in the extended position.

5. The valve of claim 4, wherein the seal member is disposed in a groove formed in the housing bore.

6. The valve of claim 1, wherein the piston member moves to the retracted position when fluid flows through the housing bore of the housing in a first direction and the fluid acts on a first surface of the piston member.

7. The valve of claim 6, wherein the piston member is at least partially biased in the extended position by fluid that flows in a second direction and the fluid acts on a second surface of the piston member, and wherein the second direction is opposite the first direction.

8. The valve of claim 1, wherein the biasing member is a spring that is positioned between a portion of the housing and the piston member.

9. The valve of claim 1, wherein the piston member includes a first end and a second end, the first end defines a portion of the housing bore when the piston member is in the retracted position.

10. A method of performing a cementing operation in a wellbore, the method comprising:

positioning a casing and a valve in the wellbore, the valve having a piston member that is movable in a housing between a retracted position and an extended position;

pumping cement through a bore of the housing;

retracting the piston member from the bore in response to the cement moving through the bore such that the cement flows past the piston member; and extending the piston member into the bore, wherein the piston member is movable at an angle that intersects the bore and whereby the piston member obstructs the bore.

11. The method of claim 10, further comprising creating a seal between the piston member and the bore of the housing when the piston member is in the extended position.

12. The method of claim 11, wherein a seal member of the piston member is configured to create the seal between the piston member and the bore.

13. The method of claim 11, wherein a seal member in the housing is configured to create the seal between the piston member and the bore.

14. The method of claim 10, further comprising biasing the piston member in the extended position.

15. The method of claim 14, wherein the piston member is at least partially biased in the extended position by wellbore fluid.

16. The method of claim 10, further comprising releasing a sleeve member from attachment to the housing.

17. The method of claim 16, wherein releasing the sleeve member comprises landing a fluid blocking member in the sleeve member.

18. The method of claim 17, further comprising increasing pressure to release the sleeve member.

19. A valve for use in a wellbore, the valve comprising:

a housing having a fluid bore and a piston bore, the piston bore intersecting the fluid bore at an angle, wherein a portion of the fluid bore extends below the piston bore; and a piston member disposed in the piston bore and movable between a first position and a second position, the piston member configured to intersect the fluid bore when the piston member is in the second position, whereby fluid communication through the piston bore is blocked.

20. The valve of claim 19, further comprising a seal member attached to the piston member, the seal member being configured to engage a surface of the fluid bore when the piston member is in the second position.

21. The valve of claim 19, further comprising a seal member disposed in the housing, the seal member being configured to engage a surface of the piston member when the piston member is in the second position.

22. The valve of claim 19, wherein the piston member is disposed within the piston bore when the piston member is in the first position, and the piston member extends from the piston bore when the piston member is in the second position.

23. The valve of claim 19, further comprising a sleeve member releasably attached to the housing, wherein the sleeve member is configured to retain the piston member in the first position.

24. The valve of claim 19, wherein the fluid bore is an eccentric bore.

* * * * *